US007726638B2

(12) United States Patent
Itagaki

(10) Patent No.: US 7,726,638 B2
(45) Date of Patent: Jun. 1, 2010

(54) SHEET PROCESSING APPARATUS AND IMAGE FORMING APPARATUS

(75) Inventor: Isao Itagaki, Moriya (JP)

(73) Assignee: Canon Finetech Inc., Misato-Shi (JP)

( * ) Notice: Subject to any disclaimer, the term of this patent is extended or adjusted under 35 U.S.C. 154(b) by 438 days.

(21) Appl. No.: 11/561,591

(22) Filed: Nov. 20, 2006

(65) Prior Publication Data

US 2007/0120309 A1 May 31, 2007

(30) Foreign Application Priority Data

Nov. 28, 2005 (JP) ..... 2005-342966

(51) Int. Cl.
*B41L 43/06* (2006.01)

(52) U.S. Cl. ..... 270/32; 270/4; 270/20.1; 270/37; 270/45; 270/58.07

(58) Field of Classification Search ..... 270/4, 270/20.1, 32, 37, 45, 58.07; 493/434, 435, 493/442, 445
See application file for complete search history.

(56) References Cited

U.S. PATENT DOCUMENTS 3,786,742 A 1/1974 Hertrich ..... 100/99
3,841,621 A * 10/1974 Brown ..... 493/8
5,346,199 A * 9/1994 Martin et al. ..... 271/110
6,268,909 B1 7/2001 Honmochi et al. ..... 355/407

FOREIGN PATENT DOCUMENTS

| | | |
|---|---|---|
| EP | 0 781 722 A2 | 7/1997 |
| EP | 0 957 408 A2 | 11/1999 |
| GB | 1 291 961 | 10/1972 |
| JP | 11-322180 | 11/1999 |

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

Provided is a sheet processing apparatus for performing a bookbinding process by folding a sheet stack, including: a folding roller pair including a first roller and a second roller brought into press contact with the first roller to be contacted/separated with/from the first roller, for conveying the sheet stack while folding the sheet stack; a plurality of urging members capable of urging the second roller in a direction of the first roller; and an urging mechanism for changing a number of the urging members for urging the second roller according to a thickness of the sheet stack to be folded.

6 Claims, 10 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly, to a sheet processing apparatus and an image forming apparatus in which a bookbinding process is performed by folding a sheet or a sheet stack on which images have been formed.

2. Description of the Related Art

Up to now, as an example of an image forming apparatus such as a copying machine and a laser beam printer, there is an image forming apparatus including a sheet processing apparatus that performs a book binding process in which discharged sheets having images formed thereon are taken in the sheet processing apparatus, the sheets are subjected to a stapling process in substantially middle portions of the sheets, and are then subjected to a process of folding the sheets in half and the like.

In the sheet processing apparatus, the sheets on which images have been formed in the image forming apparatus main body are first sequentially taken in the sheet processing apparatus, and then a stapler unit is driven to staple the substantially middle portion of the sheet stack. After that, the sheet stack is conveyed to folding means to fold the sheet stack in half by the folding means.

The folding means includes a folding roller pair and pushing means composed of a pushing plate and the like. In folding the sheet stack in half, a portion of the sheet stack corresponding to a staple position is pushed to a nip part between the folding roller pair by the pushing plate. Then, when the sheet stack is thus pushed to the nip part between the folding roller pair, the sheet stack is pressed by the folding roller pair and conveyed while being folded in half at the staple position in the middle of the sheet stack. The half-folded sheet stack is discharged to a discharge tray in a state where the sheet stack is bound.

One folding roller of the folding roller pair is set to be movable in a releasing direction by about the thickness of the sheet stack so as to nip the sheet stack. The movable folding roller is mounted to a swingably supported holding plate and is brought into press contact with the other folding roller whose position is fixed.

Here, as an example of press-contacting means for bringing one folding roller into press contact with the other folding roller, there is one in which a pressure contact force is generated using an urging member such as one linear spring (for example, see JP H11-322180 A).

However, in the sheet processing apparatus of this type, in a case where a friction coefficient between sheets is low when the folding process is performed, slippage of the sheets is caused when the half-folded sheet stack is drawn into the folding roller pair, which may cause a tear in the staple position of the sheet stack. Such the tear is likely to be caused immediately after the folding process is started. In this case, particularly when an image is formed on a portion at which the folding is started and to which toner is adhered, an inner side of the folded portion of the sheet is likely to be unfolded when the sheet is drawn into the folding roller pair, thereby easily causing the tear of the sheet.

In view of this, in order to avoid causing such the tear during the folding process, a margin is provided in advance to the middle portion of the sheet which corresponds to a folded portion of the sheet The margin is provided to the middle portion of the sheet other than the image forming portions of the sheet, thereby making it possible to make the friction coefficient between sheets larger in the folded portion, and fold the sheet stack without causing any tear or wrinkles.

However, in recent years, colorization has been progressed in the field of the image forming apparatus, and full-color images are formed on sheets in many cases, so it is necessary to reduce the margin provided to the folded portion. For this reason, a sheet stack is pushed by the pushing means to a nip point between the folding roller pair so as to fold the sheet on which an image has been formed at the folded portion without causing slippage of sheets.

In the conventional sheet processing apparatus of this type, in a case where the number of sheets to be nipped is small (for example, 2 sheets), a height of the folded sheets is constant even when the pressure contact force of the folding roller pair is small (for example, 160 N or more) On the other hand, when the number of sheets to be nipped is large (for example, 15 sheets), the height of the folded sheets is not constant if the pressure contact force of the folding roller pair is set to be large (for example, 700 N or more).

Here, up to now, the pressure contact force is set to only one value, so there arises the following problem. That is, for example when the pressure contact force is set in consideration of folding a plurality of sheets, a pressure contact force of 500 N is applied even in a case of folding 2 sheets though 2 sheets can normally be folded by a pressure contact force of about 160 N.

SUMMARY OF THE INVENTION

It is an object of the present invention to provide a sheet processing apparatus and an image forming apparatus capable of applying an optimum pressure contact force to a sheet stack according to a thickness of the sheet stack.

It is another object of the present invention to provide a sheet processing apparatus, which performs a bookbinding process by folding a sheet stack, including: a folding roller pair comprising a first roller and a second roller brought into press contact with the first roller to be contacted/separated with/from the first roller, for conveying the sheet stack while folding the sheet stack; a plurality of urging members capable of urging the second roller in a direction of the first roller; and an urging mechanism for changing a number of the urging members for urging the second roller, according to a thickness of the sheet stack to be folded.

Further features of the present invention will become apparent from the following description of exemplary embodiments with reference to the attached drawings.

DESCRIPTION OF THE EMBODIMENTS

Figure 1:
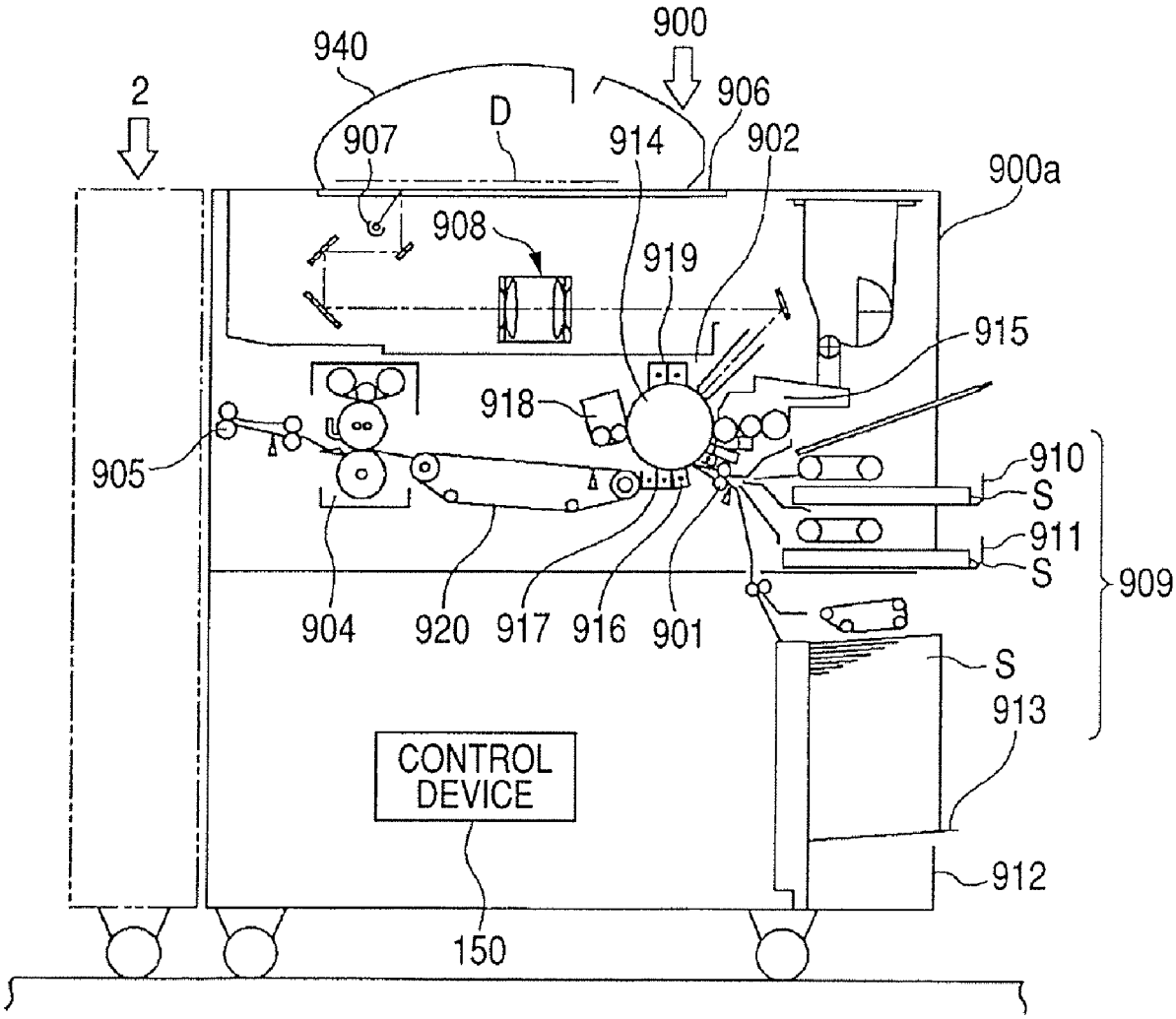
FIG. 1 is a schematic structural view of a copying machine which is an example of an image forming apparatus including a sheet processing apparatus according to an embodiment of the present invention.

FIG. 1 is a schematic structural view of a copying machine which is an example of an image forming apparatus including a sheet processing apparatus according to an embodiment of the present invention.

In FIG. 1, reference numeral 900 denotes a copying machine. An apparatus main body (hereinafter, referred to "copying machine main body") 900*a* of the copying machine 900 includes a platen glass plate 906 serving as a document stack table, a light source 907, a lens system 908, a sheet feeding part 909, and an image forming part 902. On an upper part of the copying machine main body 900*a*, there is provided an automatic document feeding apparatus 940 for automatically feeding a document D onto the platen glass plate 906. Further, the copying machine main body 900*a* is mounted with a sheet processing apparatus 2.

Here, the sheet feeding part 909 includes cassettes 910 and 911 which contain recording sheets S and are detachable from the copying machine main body 900*a*, and a deck 913 provided to a pedestal 912. In addition, in the image forming part 902 serving as image forming means, there is arranged, for example, a cylindrical photosensitive drum 914, and in the vicinity of the photosensitive drum 914, there are arranged a developing device 915, a transfer charger 916, a stripping charger 917, a cleaner 918, and a primary charger 919. On a downstream side of the image forming part 902, there are arranged a conveying apparatus 920, a fixing device 904, a discharge roller pair 905, and the like.

Next, an operation of the copying machine 900 will be described.

When a sheet feeding signal is outputted from a control device 150 provided to the copying machine main body 900*a*, the sheet S is fed from the cassettes 910 and 911 or the deck 913. On the other hand, a light beam which is emitted from the light source 907 and reflected on the document D loaded on the platen glass plate 906 is irradiated on the photosensitive drum 914 through the lens system 908.

Here, the photosensitive drum 914 is charged in advance by the primary charger 919 and irradiated with light to form an electrostatic latent image thereon. Then, the electrostatic latent image is developed by the developing device 915, thereby forming a toner image. Skew of the sheet S fed from the sheet feeding part 909 is corrected by registration rollers 901, and the sheet S is further conveyed to the image forming part 902 in a predetermined timing.

Then, in the image forming part 902, the toner image formed on the photosensitive drum 914 is transferred onto the sheet S by the transfer charger 916. After that, the sheet S on which the toner image has been transferred is charged to a polarity opposite to that of the transfer charger 916 by the stripping charger 917, to thereby strip the sheet S from the photosensitive drum 914.

The stripped sheet S is conveyed to the fixing device 904 by the conveying apparatus 920, and a transfer image is permanently fixed onto the sheet S by the fixing device 904. Further, after the image is thus formed on the sheet S, the sheet S is discharged from the copying machine main body 900*a* to the sheet processing apparatus 2 by the discharge roller pair 905.

Here, the sheet processing apparatus 2 performs a process in which the sheets on which images have been formed in the image forming apparatus 900 are stapled and folded in half. The sheets discharged from the copying machine main body 900*a* are folded in half and bound by the sheet processing apparatus 2.

Figure 2:
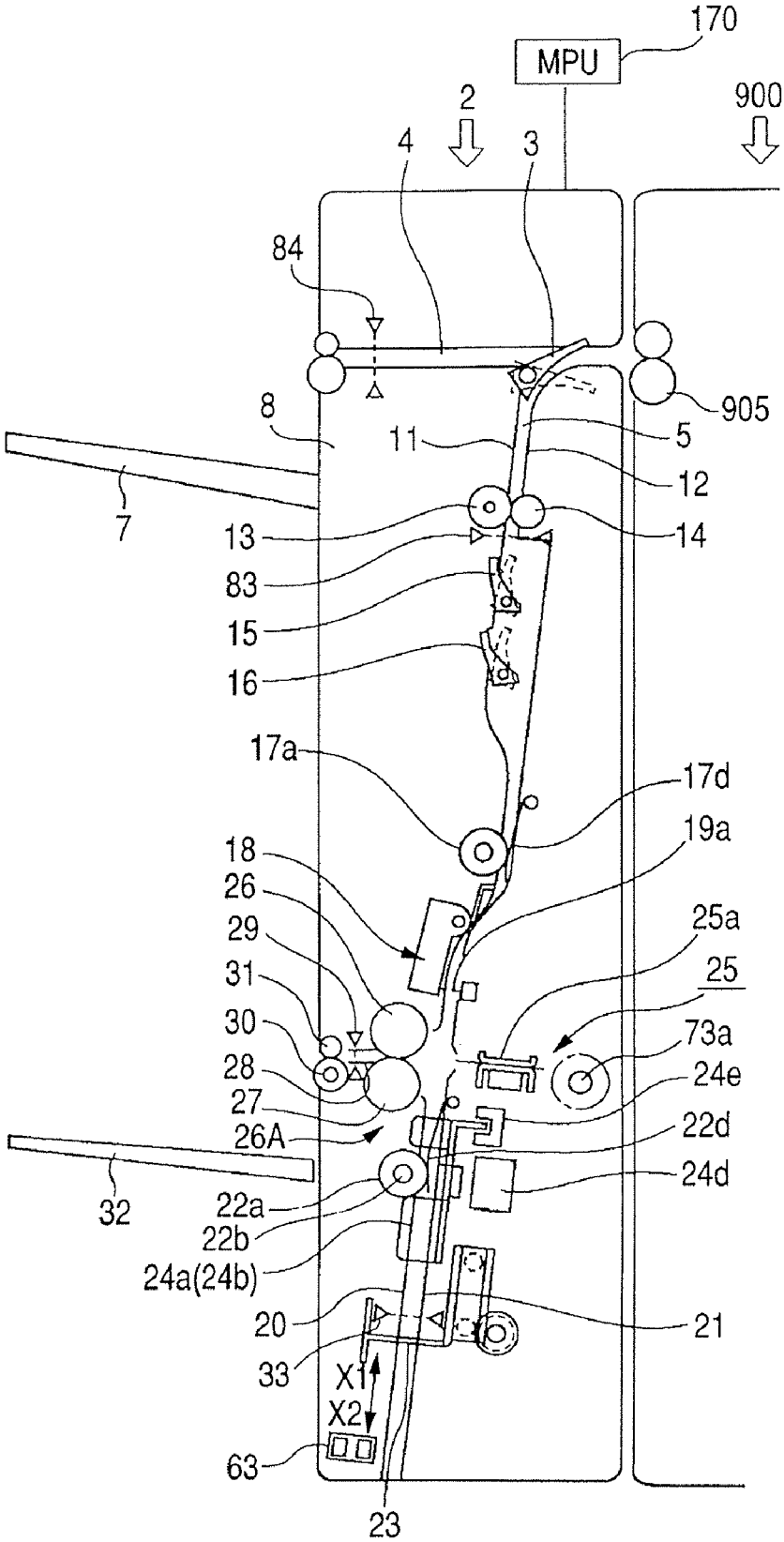
FIG. 2 is a structural view of the sheet processing apparatus.

FIG. 2 is a structural view of the sheet processing apparatus 2. In FIG. 2, reference numeral 8 denotes a sheet processing apparatus main body, and reference numeral 3 denotes an entrance flapper. The entrance flapper 3 performs switching between a bookbinding mode and a stack mode by turning on and off of an entrance solenoid 3*c* (see FIG. 5).

The entrance flapper 3 moves to a position indicated by the broken line when the stack mode is set, to thereby discharge the sheet conveyed from the copying machine 900 to a sample tray 7 through a stack path 4. Further, the entrance flapper 3 moves to a position indicated by the solid line when the bookbinding mode is set, to thereby guide the sheet conveyed from the copying machine 900 to a bookbinding path 5.

Reference numerals 11 and 12 each denote a guide constituting the bookbinding path 5, reference numeral 13 denotes a first conveying roller provided to the bookbinding path 5, and reference numeral 14 denotes a conveying runner brought into press contact with the first conveying roller 13. Each of upper and lower switching flappers 15 and 16 are structured to be movable to two positions, that is, a position indicated by the alternate long and short dash line and a position indicated by the solid line, by turning on and off switching solenoids 15*d* and 16*d* (see FIG. 5).

Reference symbols 17*a* and 22*a* denote second and third conveying rollers, respectively, and reference symbols 17*d* and 22*d* are elastic members brought into contact with the second and third conveying rollers 17*a* and 22*a*, respectively. Sheets are pressed against the conveying rollers 17*a* and 22*a* by the elastic members 17*d* and 22*d*.

Then, the second and third conveying rollers 17*a* and 22*a* receive the sheets conveyed from the first conveying roller 13 to further convey the sheets. When a stopper sensor 33 detects that a leading edge of the sheet reaches a leading edge stopper 23 to be described later, the conveyance of the sheet is stopped.

Reference numeral 18 denotes a staple unit for stapling a sheet stack. The staple unit 18 includes two staplers (not shown) arranged to be spaced apart from each other at a predetermined interval in a width direction. Reference numerals 20 and 21 each denote a guide arranged on the downstream side of the staple unit 18, and reference symbols 24*a* and 24*b* each denote an aligning member (i.e., aligning means) for aligning sheets while pressing the sheets from both sides thereof.

The leading edge stopper (i.e., positioning means) 23 receives the leading edge of the sheet stack entering between the guides 20 and 21. The leading edge stopper 23 is structured to be movable in a direction X1 and a direction X2 shown in FIG. 2 between the guides 20 and 21, thereby performing positioning of a staple position by the staple unit 18 and a folding position to be described later.

Above the leading edge stopper 23, the above-mentioned stopper sensor 33 is arranged. Between the staple unit 18 and the leading edge stopper 23, there is arranged a sheet stack folding apparatus constituted of a folding roller pair 26A composed of folding rollers 26 and 27, and a pushing unit 25 provided with a pushing plate 25*a* serving as a pushing member.

The pushing plate 25*a* of the pushing unit 25 is an example of a sheet stack pressing member for guiding the sheet stack to a nip caused between the folding roller pair 26A. Before folding the sheet, the pushing plate 25*a* evacuates to an outside of the guides 12 and 21, and the folding rollers 26 and 27 of the folding roller pair 26A are brought into press contact with each other.

Reference numeral 28 denotes a discharge guide for guiding the sheet stack to be discharged which has been nipped by the folding roller pair 26A to a nip point between a discharge roller 30 and a discharge runner 31. Reference numeral 29 denotes a discharge sensor for detecting a leading edge and a trailing edge of the sheet stack to be conveyed while being folded by the folding roller pair 26A. Reference numeral 32 denotes a stack tray. The sheet stack discharged by the discharge roller 30 and the discharge runner 31 is stacked on a substantially horizontal stack surface of the stack tray 32.

Next, a drive mechanism of the sheet stack folding apparatus will be described with reference to FIGS. 3 and 4.

Figure 3:
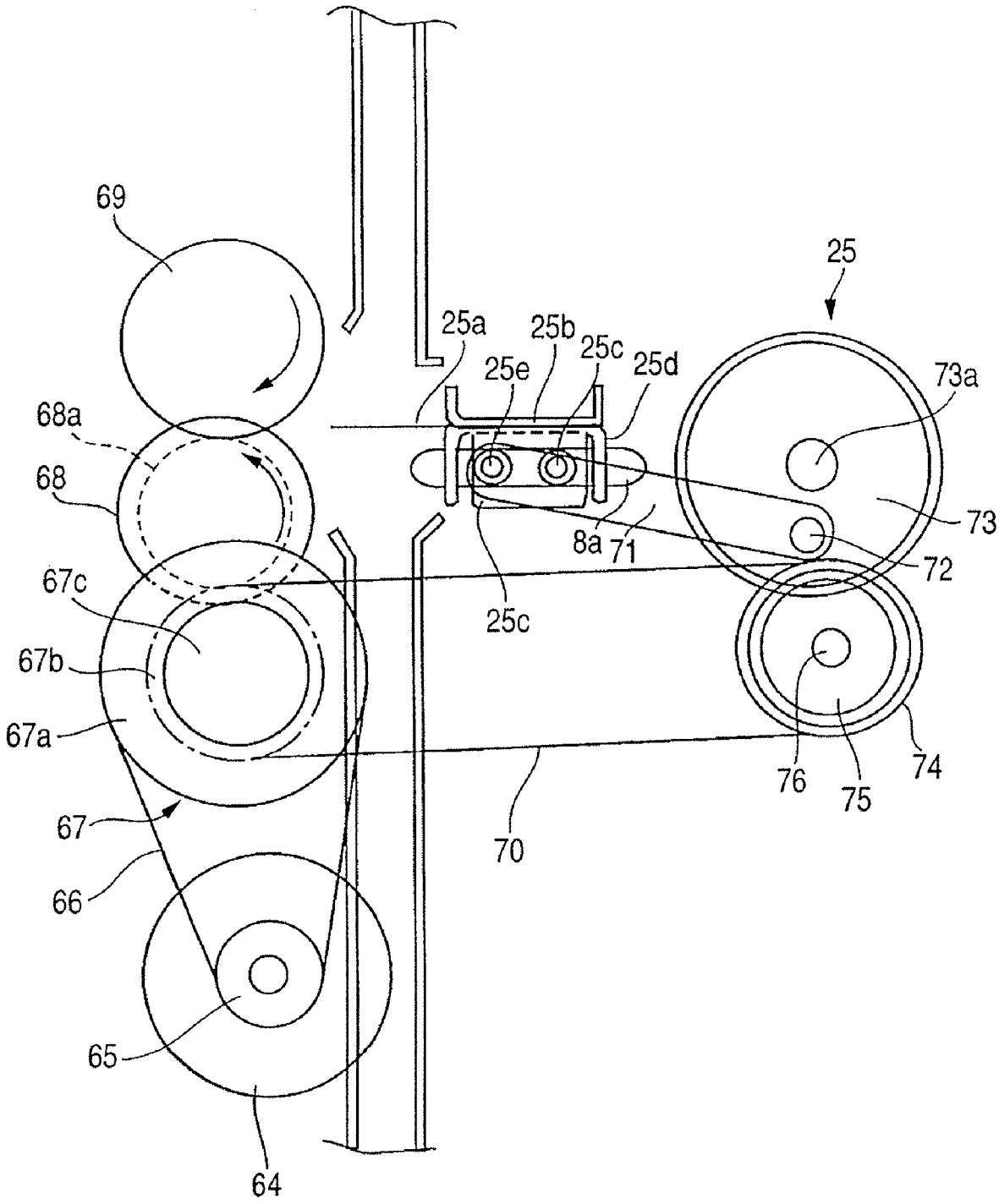
FIG. 3 is a side view of a drive mechanism for a sheet stack folding apparatus provided to the sheet processing apparatus.
Figure 4:
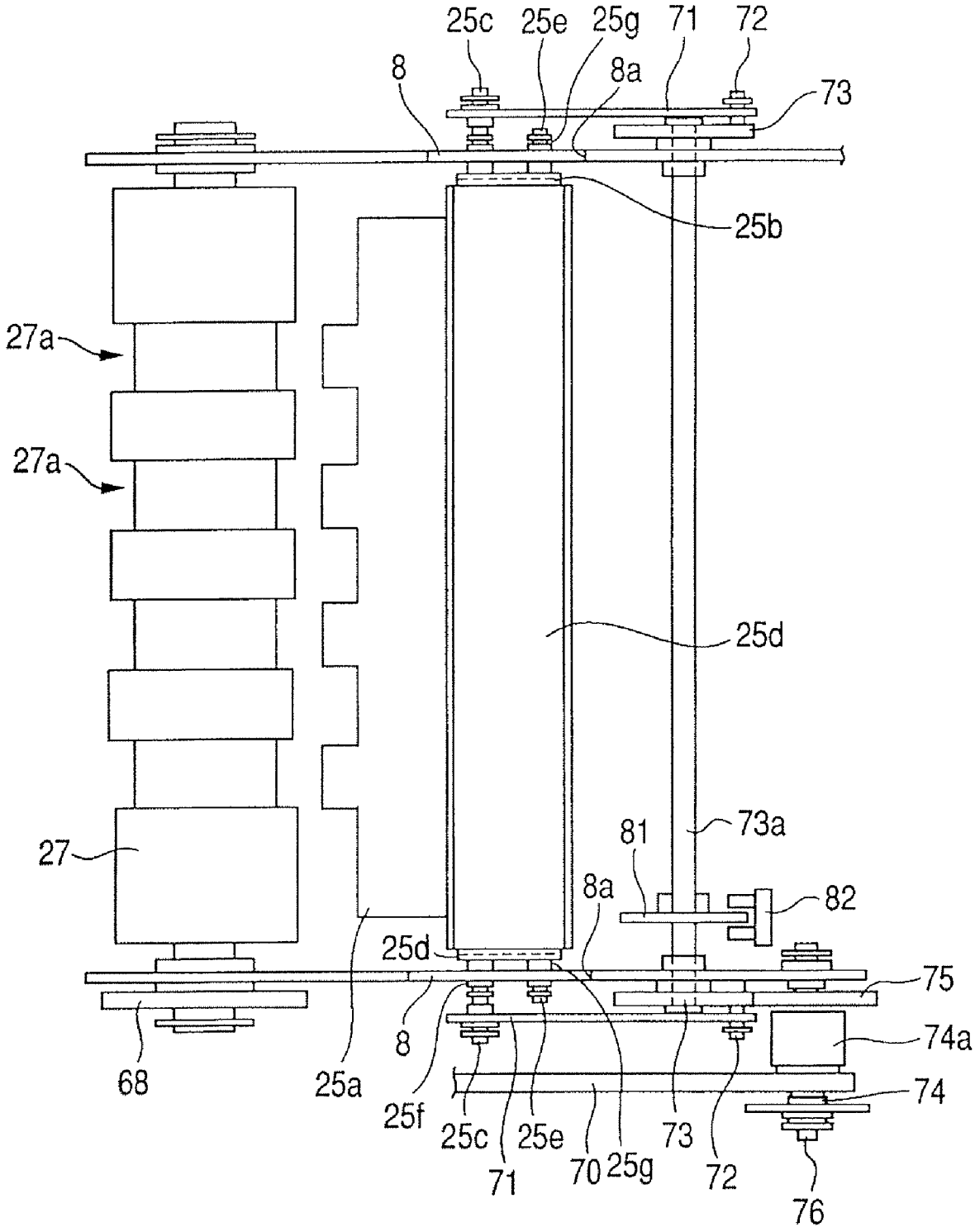
FIG. 4 is a plan view of the drive mechanism for the sheet stack folding apparatus provided to the sheet processing apparatus.

In FIGS. 3 and 4, reference numeral 64 denotes a folding motor, and a pulley 65 is fixed on an output shaft of the folding motor 64. Reference numeral 67 denotes an idler gear pulley constituted of two columns of pulleys and gears which are coaxially arranged. A timing belt 66 is wound around a pulley 67*a*, which is one column of the two columns of the pulleys, and the pulley 65.

Reference numerals 68 and 69 denote folding gears fixed to the folding rollers 26 and 27, respectively, to be engaged with each other. The folding gear 68 is engaged with a gear part 67*c* of the idler gear pulley 67.

Figure 8:
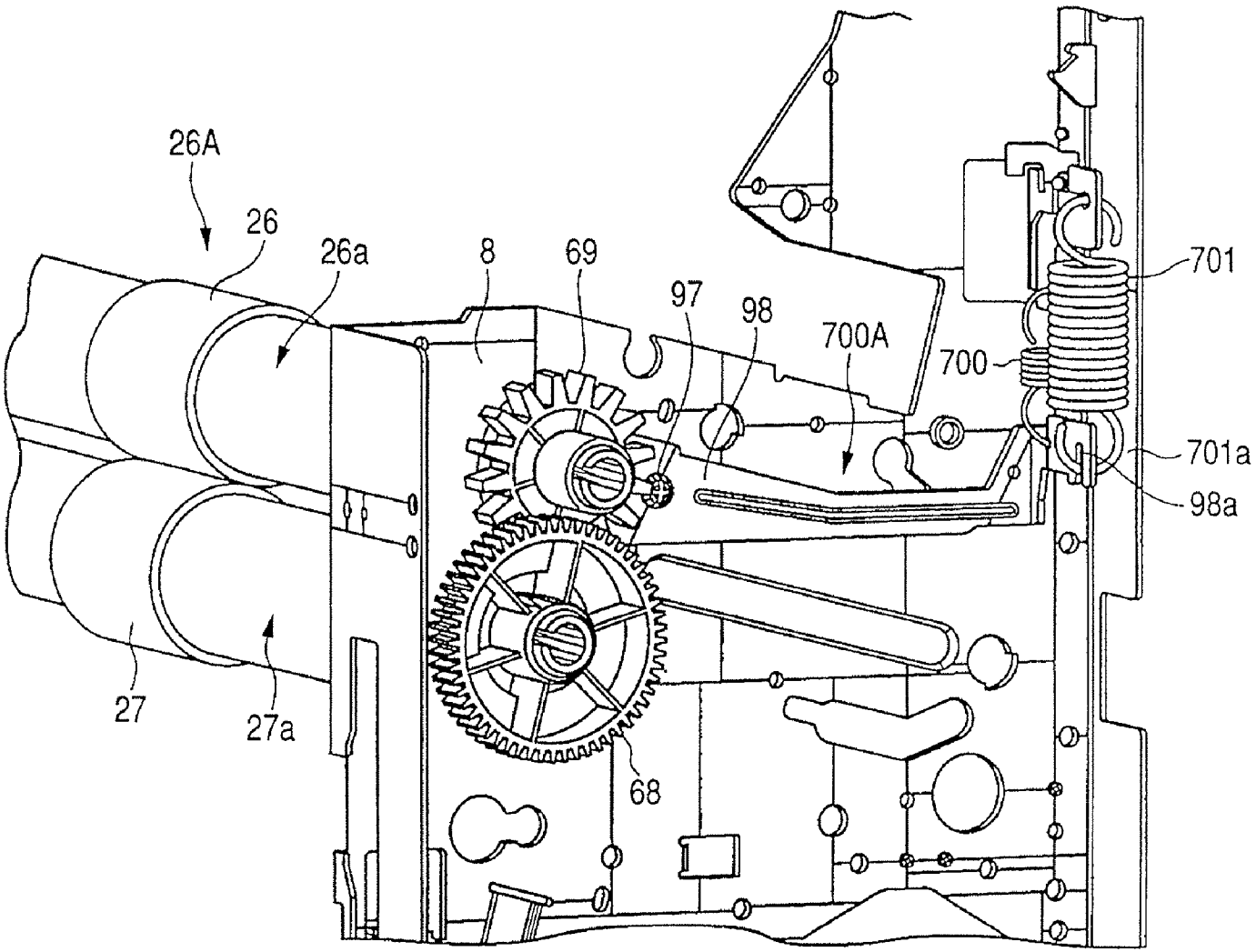
FIG. 8 is a perspective view for explaining a nip mechanism of a folding roller pair provided to the sheet stack folding apparatus.

The folding roller 26 is mounted to a support plate 98 pivotally provided around a spindle 97 on a frame 8 as shown in FIG. 8 to be described later. Further, the folding roller 26 is brought into press contact with the folding roller 27 mounted to the frame 8 by springs 700 and 701. Thus, a distance between the folding rollers 26 and 27 is changed according to the thickness of the sheet stack. The folding roller pair 26A will be described in detail later.

The pushing plate 25*a* of the pushing unit 25 is made of a thin and hard material such as a stainless steel, and is held by pushing plate holders 25*b* and 25*d*. Shafts 25*c* and 25*e* are fixed to the pushing plate holders 25*b* and 25*d*, and each of the sliding runners 25*f* and 25*g* is rotationally mounted around an outer periphery of each of the shafts 25*c* and 25*e*.

A gear 73 partially constitute a shaft 72, and an idler gear 75 is engaged with the gear 73. An electromagnetic clutch (i.e., folding clutch) 74*a* is arranged on a shaft 76 of the idler gear 75, and transfer of rotation of a pulley 74 to the shaft 76 is controlled by the electromagnetic clutch 74*a*. A timing belt 70 which is wound around a pulley part 67*b* of the idler gear pulley 67 at one end thereof is wound around the pulley 74 at the other end.

On a shaft 73*a* of the gear 73, a flag 81 partially having a notch is fixed. At a position where the notch of the flag 81 is detected, a pushing home sensor 82 is arranged. The pushing home sensor 82 is arranged so as to detect the notch of the flag 81 at a position where the pushing plate 25*a* recedes most with respect to the conveying surface constituted by the guides 12 and 21.

In the drive mechanism with such the structure, the rotation of the folding motor 64 is transferred to the idler gear pulley 67 from the pulley 65 through the timing belt 66. Then, the rotation of the idler gear pulley 67 is transferred to the folding gear 69 from a gear part 68*a* which is one of two gear parts of the gear 68, thereby driving the folding rollers 26 and 27.

When the sheet stack is folded as described later, the folding gear 69 ascends integrally with the folding roller 26 according to the thickness of the sheet stack. Also in this case, heights of teeth of the folding gears 69 and 68 are adjusted to engage the folding gear 69 with the folding gear 68.

Further, the rotation of the idler gear pulley 67 is transferred to the pulley 74 provided on the electromagnetic clutch 74*a* through the timing belt 70. By turning on and off the electromagnetic clutch 74*a*, the rotation of the pulley 74 is transferred to the shaft 76, thereby rotating the idler gear 75. Through the rotation, the gear 73 is rotated, and the shaft 72 which is located beside the shaft 73*a* of the gear 73 is circulated.

Here, one end of a link 71 is fitted into the shaft 72. The other end of the link 71 is fitted into the shaft 25*c* fixed to the pushing plate 25*a*, and is further fitted into a groove 8*a* of the frame 8 through a runner together with the shaft 25*c*. Thus, when the gear 73 is rotated, the pushing plate 25*a* linearly moves along the groove 8*a*.

During such the linear motion, the leading end of the pushing plate 25*a* is pushed to the nip point between the folding rollers 26 and 27 of the folding roller pair 26A. Here, the sheet is thus pushed by the pushing plate 25*a* to the nip point between the folding rollers 26 and 27 of the folding roller pair 26A, thereby forming an image on the folded portion of the sheet. As a result, even the sheet stack having a low friction coefficient between sheets can be bound without causing any tear of the sheets. On the periphery of the respective rollers of the folding roller pair 26A, there are provided concave portions 26*a* and 27*a*, respectively, so as not to interfere with the leading end of the pushing plate 25*a*.

Thus bound sheet stack is discharged by the discharge roller 30. On the other hand, the discharge roller 30 is driven by a torque transferred from a discharge motor 91 shown in FIG. 5 through a pulley and a timing belt (not shown).

The discharge motor 91 is constituted of a stepping motor, and a circumferential speed of the discharge roller 30 is set to be higher than that of the folding rollers 26 and 27.

Each conveying force of the folding rollers 26 and 27 is set to be larger than that of the discharge rollers 30 and 31. For this reason, when the sheet is nipped and conveyed by the folding rollers 26 and 27, slippage of the sheet is caused, and when the sheet passes through the folding rollers 26 and 27, the sheet is conveyed by the conveying force of the discharge rollers 30 and 31.

Figure 5:
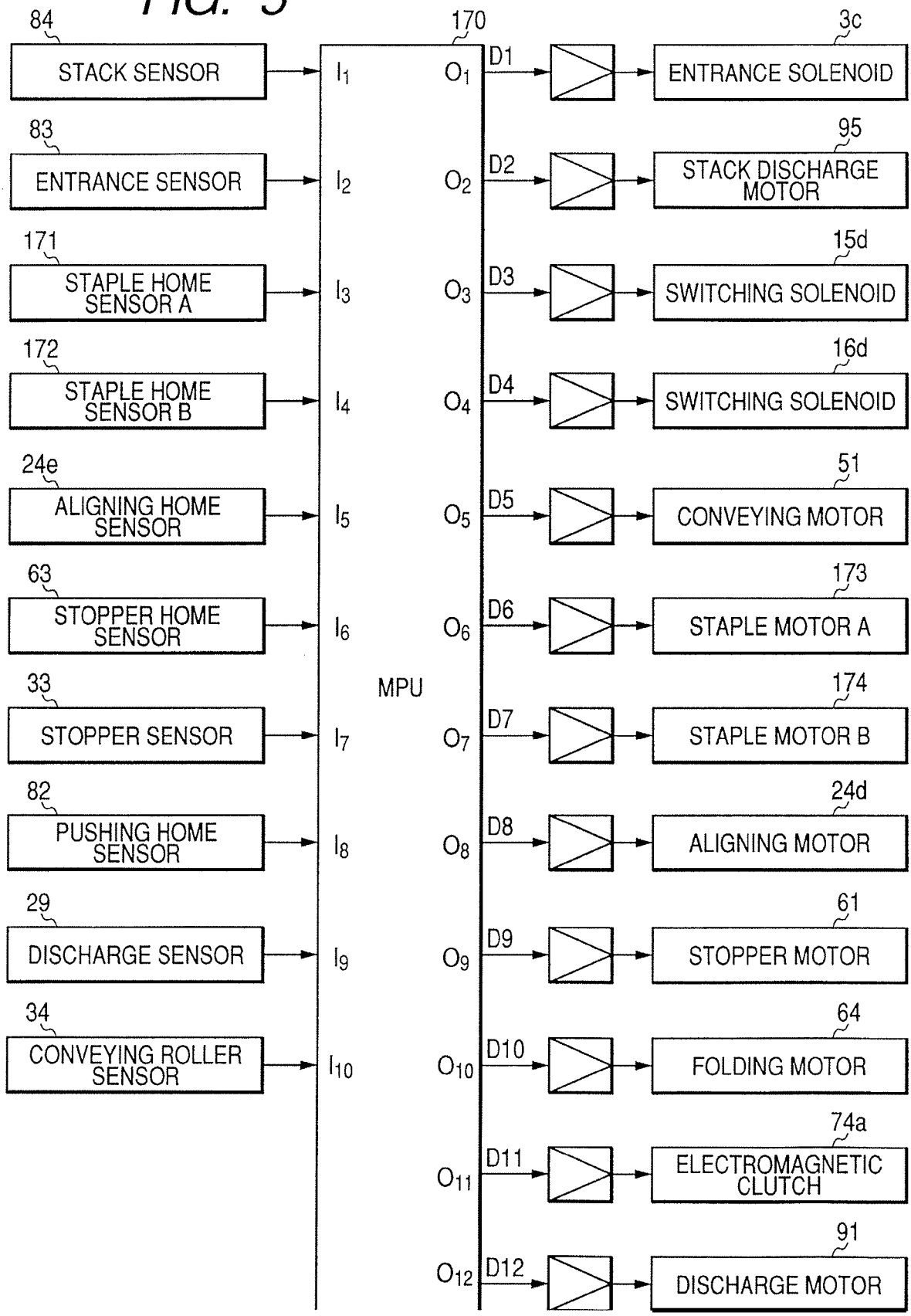
FIG. 5 is a control block diagram of the sheet processing apparatus.

FIG. 5 is a control block diagram of the sheet processing apparatus 2 with the above-mentioned the structure. In FIG. 5, reference numeral 170 denotes an MPU which is an example of control means for controlling the sheet processing apparatus 2. The MPU 170 stores therein a program corresponding to operations to be described later, and executes the program to control parts provided in the sheet processing apparatus and to communicate with a controlling part and the like (not shown) of the copying machine main body 900*a*.

The MPU 170 is connected to a stack sensor 84 shown in FIG. 2, an entrance sensor 83, and a staple home sensor A 171 and a staple home sensor B 172 for two staplers (not shown), respectively. In addition, the MPU 170 is connected to an aligning home sensor 24*e* for the aligning members 24*a* and 24*b*, a stopper home sensor 63 for detecting that the leading edge stopper 23 shown in FIG. 2 is located at a home position, and the above-mentioned stopper sensor 33, respectively.

Further, the MPU 170 is connected to the pushing home sensor 82 for the pushing plate 25*a*, the discharge sensor 29, a conveying roller sensor 34, the entrance solenoid 3*c*, a stack discharge motor 95, and the switching solenoids 15*d* and 16*d*, respectively. In addition, the MPU 170 is connected to a conveying motor 51 for driving first to third conveying rollers and the like, a staple motor A 173 and a staple motor B 174, and an aligning motor 24*d* for moving the aligning members 24*a* and 24*b* in the width direction, respectively. Further, the MPU 170 is connected to a stopper motor 61 for moving the leading edge stopper in a vertical direction, the folding motor 64, the electromagnetic clutch 74*a* for driving the pushing plate 25*a*, the discharge motor 91, and the like, respectively.

Figure 6:
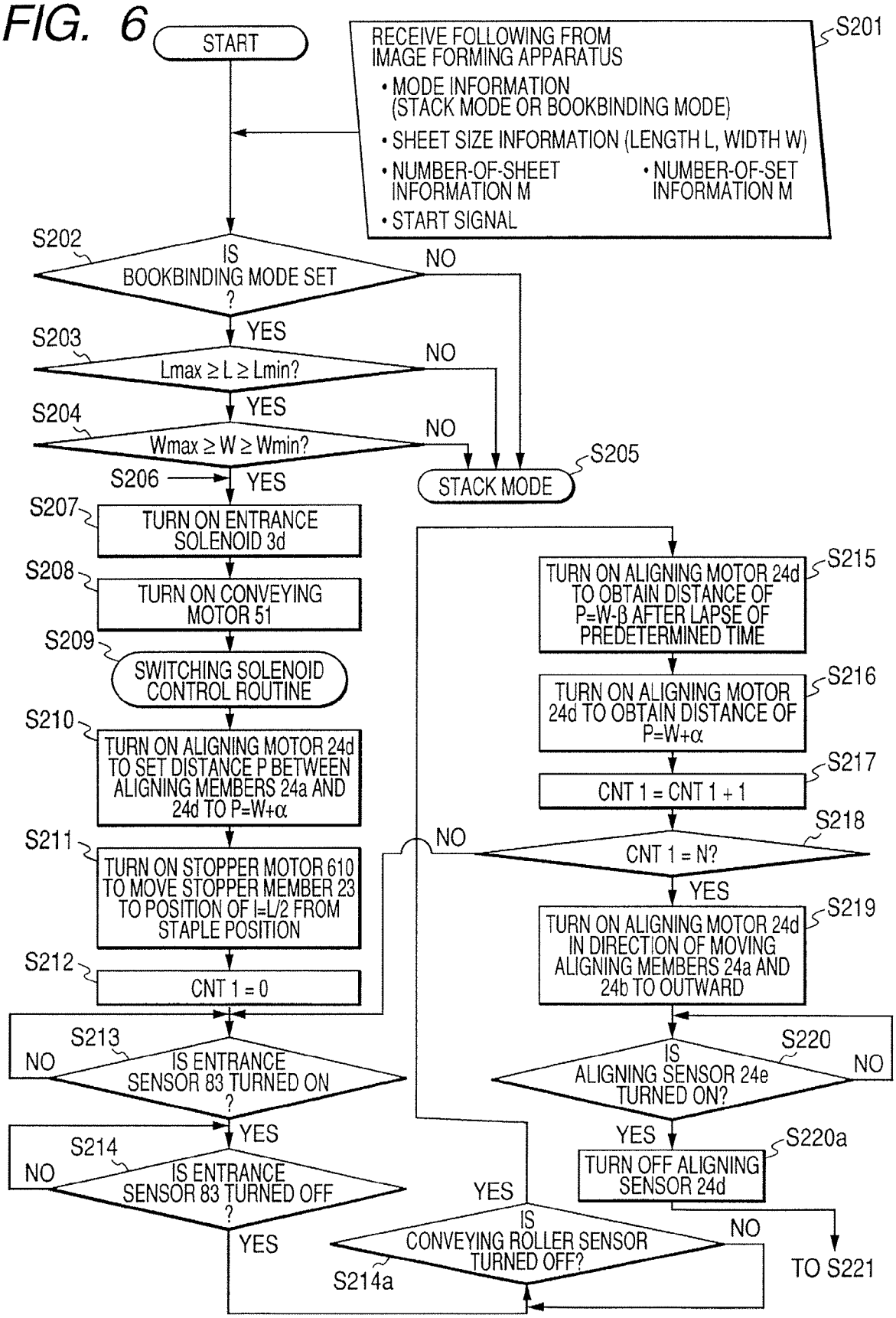
FIG. 6 is a first flowchart showing a control sequence (i.e., main routine) of an MPU of the sheet processing apparatus.
Figure 7:
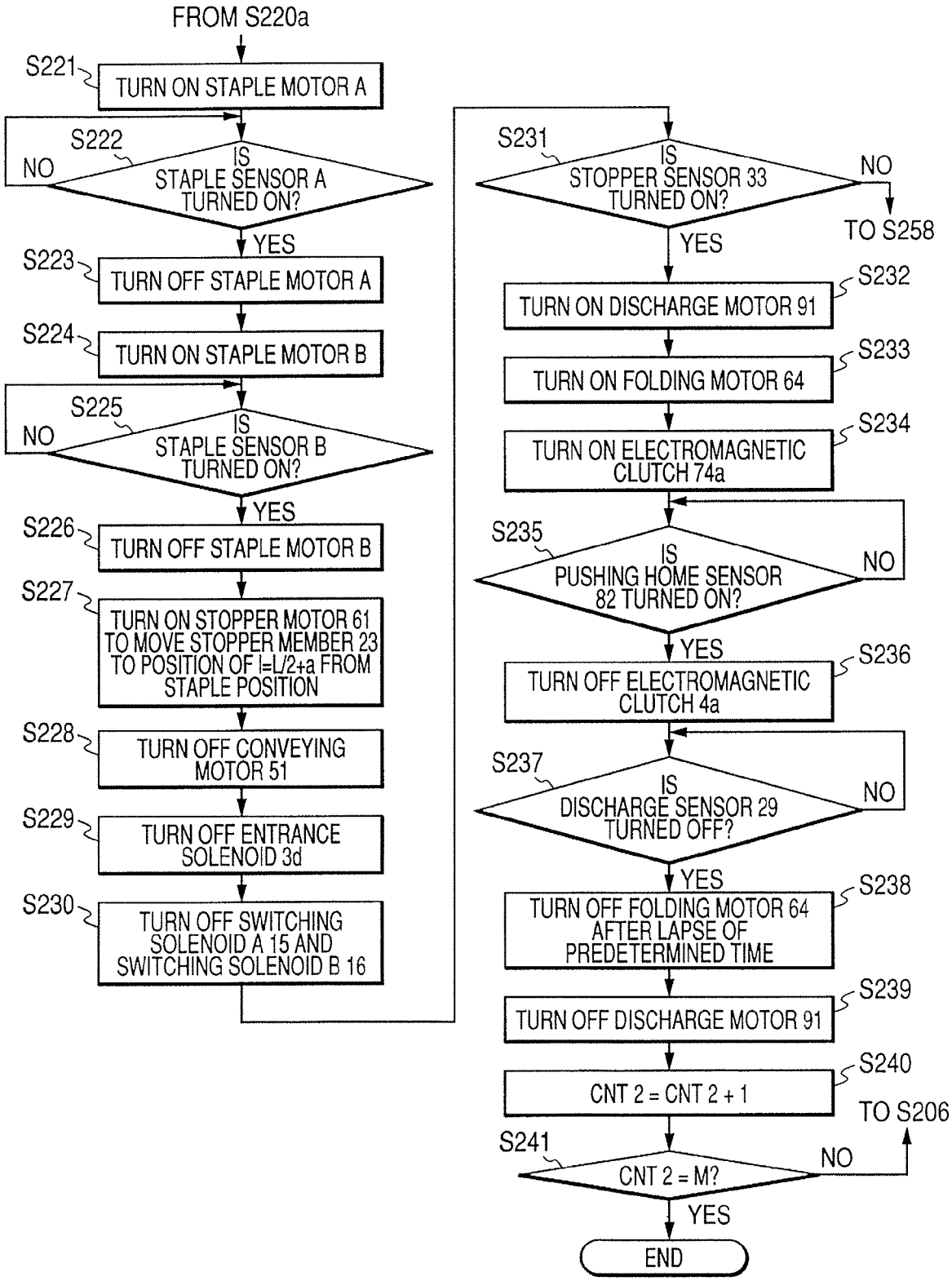
FIG. 7 is a second flowchart showing the control sequence (i.e., main routine) of the MPU of the sheet processing apparatus.

Next, a control sequence of the MPU 170 in the sheet processing apparatus 2 will be described with reference to FIGS. 6 and 7.

The MPU 170 receives from the image forming apparatus 900 mode information indicating a bookbinding mode or a stack mode, sheet size information indicating a sheet length L and a sheet width W, number-of-sheet information N, and number-of-set information M. Then, upon reception of a start signal, the MPU 170 starts operating (S201).

The MPU 170 confirms the set mode (S202), and when the bookbinding mode is not set (N in S202), the process proceeds to a subroutine of the stack mode (S205). When the bookbinding mode is set (Y in S202), the MPU 170 confirms whether the length L is in a range between $L_{max}$ and $L_{min}$ in which processing can be performed by the sheet processing apparatus 2 (S203). On the other hand, when the length L is not in the range between $L_{max}$ and $L_{min}$ (N in S203), the MPU 170 performs a stack mode process (S205).

Next, when the length L is in the range between $L_{max}$ and $L_{min}$ (Y in S203), the MPU 170 also confirms whether the width W is in a range between $W_{max}$ and $W_{min}$ in which processing can be performed by the sheet processing apparatus 2 (S204). When the width W is not in the range between $W_{max}$ and $W_{min}$ (N in S204), the MPU 170 sets the stack mode (S205). When the width W is in the range between $W_{max}$ and $W_{min}$ (Y in S204), the MPU 170 turns on the entrance solenoid 3*d* (S207) to open the bookbinding path 5. After that, the MPU 170 turns on the conveying motor 51 (S208) to rotate the rollers and the like.

Next, the process proceeds to a switching solenoid control routine for controlling the switching solenoids 15*d* and 16*d* (S209). After that, the number of steps obtained by setting a distance P between the aligning members 24*a* and 24*b* to P=W+α (herein, α represents a gap between a sheet stack and a pushing part of the aligning member) is sent to the aligning motor 24*d*, whereby the MPU 170 turns on (i.e., rotates) the aligning motor 24*d* (S210).

Next, the number of steps for the stopper member 23 to move to a position corresponding to 1=L/2 downstream from a staple position 19*a* of the staple unit 18 is sent to the stopper motor 61, whereby the MPU 170 turns on (i.e., rotates) the stopper motor 61 (S211).

After that, the MPU 170 sets a sheet-number counter CNT1 to 0 (S212), and confirms a signal of the entrance sensor 83 (S213). When the signal of the entrance sensor 83 is turned on (Y in S213), the signal of the entrance sensor 83 is thereafter turned off (Y in S214), and the MPU 170 waits until the conveying roller sensor is turned off (S214*a*).

Next, when the conveying roller sensor is turned off (Y in S214*a*), after the elapse of a time t required for the leading edge of the sheet stack to abut against the stopper 23, the MPU 170 sends the number of steps for the aligning members 24*a* and 24*b* to move to a position corresponding to P=W−β, to the aligning motor 24*d*, and turns on (i.e., rotates) the aligning motor 24*d* (S215) Herein, β represents an amount of pressing sheets by the aligning members 24*a* and 24*b*. After that, the MPU 170 sends the number of steps for the aligning members 24*a* and 24*b* to move to a position corresponding to P=W+α, to the aligning motor 24*d*, and turns on (i.e., rotates) the aligning motor 24*d* (S216).

Next, the MPU 170 causes the sheet-number counter CNT1 to increment by one (S217), and confirms whether the sheet-number counter CNT1 reaches a desired number N (S218) When the sheet-number counter CNT1 does not reach the desired number N (N in S218), the MPU 170 returns to S213 to perform the same processing on the sheet fed from the image forming apparatus 900. When the sheet-number counter CNT1 reaches the desired number N (Y in S218), the MPU 170 turns on the aligning home sensor 24*e* (S220) and turns on (i.e., rotates) the aligning motor 24*d* in a direction of moving the aligning members 24*a* and 24*b* outwardly (S219) When the aligning home sensor 24*e* is turned on (Y in S220), the MPU 170 turns off the aligning motor 24*d* (S220*a*).

Next, prior to the stapling process for the sheet stack, one of the two staplers starts stapling sheets. As a result, the MPU 170 turns on the staple motor A (S221), and when a staple sensor A is turned on (i.e., detected) (Y in S222), the MPU 170 turns off the staple motor A (S223) After that, the MPU 170 causes the other staplers to perform the same operations (S224, S225, and S226), and completes the stapling operation.

Next, the MPU 170 turns on (i.e., rotates) the stopper motor 61 by the number of steps for the stopper member 23 to move to a position corresponding to 1=(L/2)+c on the downstream side from the staple position 19*a* (S227). Herein, a symbol c represents a distance between the staple position 19*a* (see FIG. 2) and the folding position. In this case, the center (i.e., stapled position) of the sheet stack is located on a line connecting the nip position between the folding roller pair 26A and the pushing plate 25*a*.

Next, the MPU 170 turns off the conveying motor 51, the entrance solenoid 3*c*, and the switching solenoids 15 and 16 to be prepared for the folding operation (S228 to S230). After that, when confirming that the stopper sensor 33 is turned on (Y in S231), the MPU 170 turns on the discharge motor 91 (S232) and turns on the folding motor 64 (S233).

Next, the MPU 170 turns on the electromagnetic clutch 74*a* (S234). As a result, the pushing plate 25*a* starts moving linearly in the direction of the folding roller pair 26A to guide the sheet stack to the nip part between the folding roller pair 26A. After that, when confirming that the pushing home sensor 82 is turned on (Y in S235), the MPU 170 turns off the electromagnetic clutch 74*a* (S236).

Next, when confirming that the discharge sensor 29 is turned off (Y in S237), the MPU 170 starts a timer. When confirming with the timer that the predetermined period of time sufficient for the trailing edge of the sheet stack to pass through the discharge rollers 30 and 31 has elapsed, the MPU 170 turns off the folding motor 64 (S238), and turns off the discharge motor 91 (S239). In this case, the speed of the discharge motor is lowered immediately after the discharge sensor 29 is turned off so that the trailing edge of the sheet stack passes through the discharge rollers at low speed.

Next, the MPU 170 causes a set-number counter CNT2 to increment by one (S240), and confirms whether the set-number counter CNT2 reaches a desired number M of sets. When the set-number counter CNT2 does not reach the desired number M of sets (S241), the MPU 170 returns to S206.

When the set-number counter CNT2 reaches the desired number M of sets, the MPU 170 completes the operation (S242).

Next, a nip mechanism of the folding roller pair will be described with reference to FIG. 8.

The swingable upper folding roller 26 constituting the folding roller pair 26A is mounted to the support plate 98. The support plate 98 is an example of the holding member swingably supported around the spindle on the frame 8 of the sheet processing apparatus 2.

As a result, it is possible to change a distance between the lower folding roller 27 (i.e., first roller) whose position is fixed, and the swingable upper folding roller 26 (i.e., second roller) brought into press contact with the lower folding roller 27 to be contacted/separated with/from the lower folding roller 27, both rollers being mounted to the frame 8 according to the thickness of the sheet stack.

Further, a plurality of springs, that is, the first spring 700 and the second spring 701 for generating a pressure contact force between the folding rollers are mounted between an end portion of the support plate 98 which is opposite to an end portion thereof at which the upper folding roller 26 is held, and the frame 8. The first spring 700 and the second spring 701 are illustrated as an example of two urging members. Then, the upper folding roller 26 is brought into press contact with the lower folding roller 27 by the first spring 700 and the second spring 701 through the support plate 98.

In this embodiment, an urging mechanism 700A is structured such that the first spring 700, the second spring 701, and the support plate 98 urge the upper folding roller 26 in the direction of the lower folding roller 27.

Here, the first spring 700 generally brings the upper folding roller 26 into press contact with the lower folding roller 27 through the support plate 98 to generate the pressure contact force between the folding rollers. The first spring 700 brings the upper folding roller 26 into press contact with the lower folding roller 27 with a predetermined pressure.

On one end portion of the support plate 98 on the spring side, there is provided an engaging groove 98*a* as an allowance. The engaging groove 98*a* is mounted with an engaging part 701*a* at the lower end of the second spring 701. Here, the second spring 701 is normally mounted to the support plate 98 in a state of the spring with a natural length. In this case, the engaging part 701*a* of the second spring 701 is positioned midway through the engaging groove 98*a*, so the second spring 701 does not generate the pressure contact force of the folding roller pair.

However, for example, when a sheet stack formed of 10 or more sheets enters between the folding roller pair 26A to thereby increase a moving amount of the upper folding roller 26, the support plate 98 is swung to a large extent, and a moving amount of the support plate 98 on the spring side is also increased.

Figure 9:
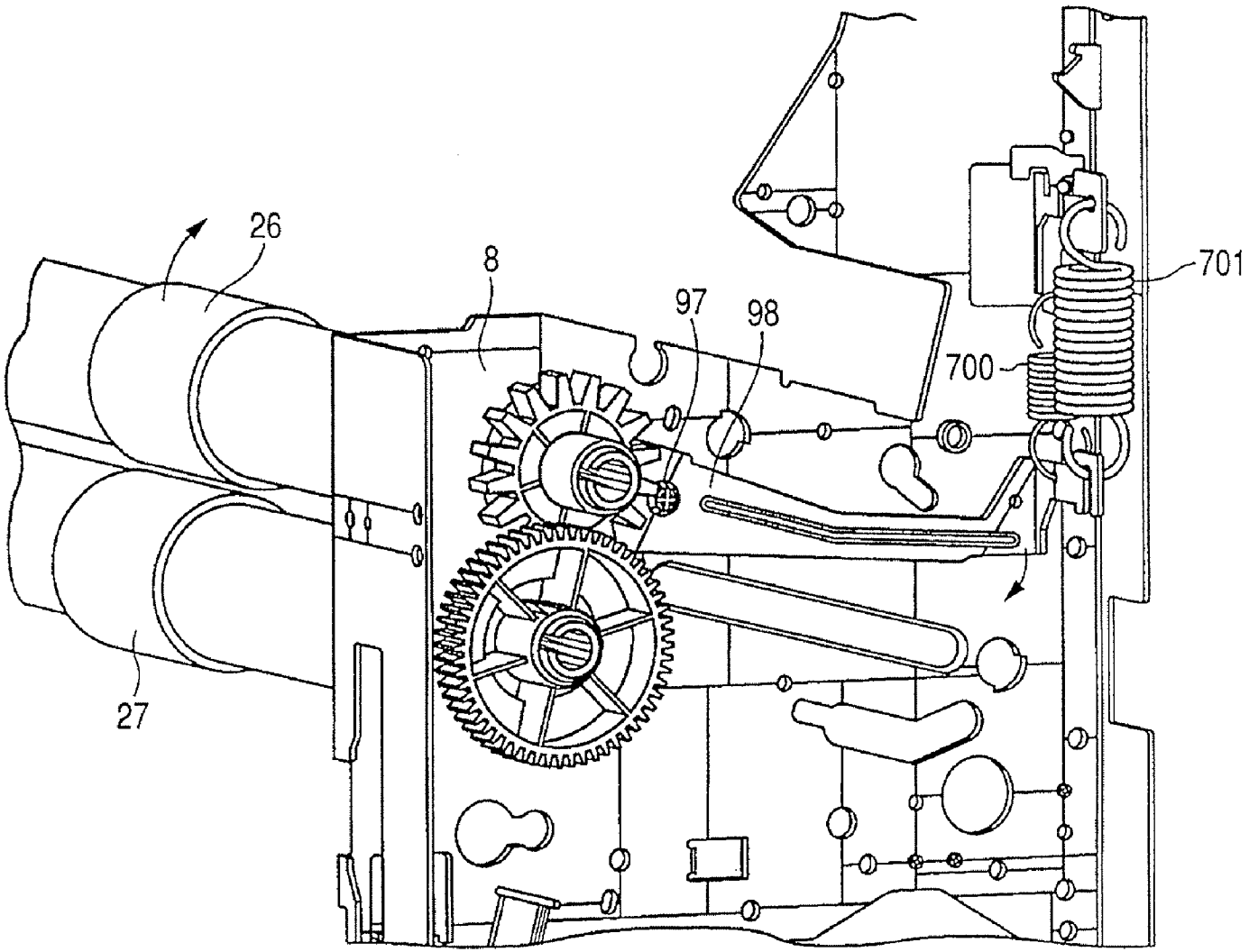
FIG. 9 is a perspective view showing a state of the nip mechanism of the folding roller pair when a plurality of sheets are folded.

When the moving amount of the support plate 98 on the spring side is thus increased, the engaging part 701*a* at the lower end of the second spring 701 which stands by with a free length at an initial position is engaged with the support plate 98 as shown in FIG. 9. As a result, the two springs 700 and 701 generate the pressure contact force between the folding roller pair 26A.

Figure 10:
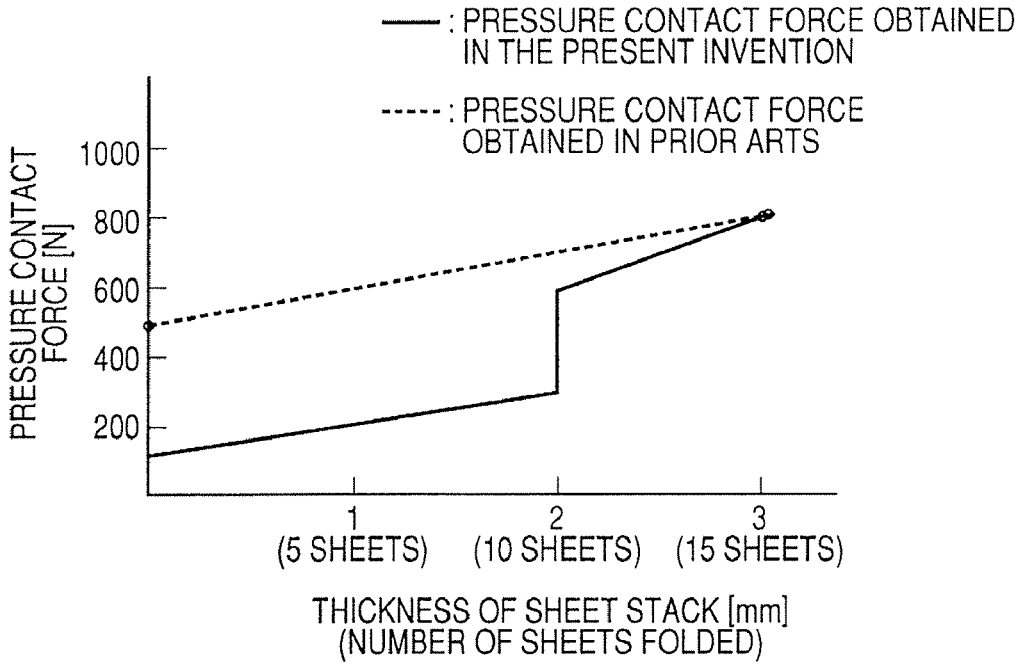
FIG. 10 is a graph showing a relationship between a thickness of a sheet stack nipped by the folding roller pair and a pressure contact force applied to the sheet stack in the sheet stack folding apparatus.

With such the structure, a relationship between the number of sheets and the pressure contact force of the folding roller pair 26A is represented as in FIG. 10. As shown in FIG. 10, in a case of stapling a small number of sheets, that is, 10 sheets or less, the pressure contact force of the folding roller pair 26A is generated by the first spring 700 only, so the pressure contact force is small. Thus, a load on the pushing plate 25*a* becomes small, and the sheet stack can be folded with a power consumption of about 36 W.

Further, in a case of stapling a large number of sheets, that is, 10 sheets or more, when the sheet stack is pushed to the nip part between the folding roller pair 26A, the pressure contact force of the folding roller pair 26A generated when the sheet stack enters between the folding roller pair 26A becomes small. Thus, a load on the pushing means also becomes small.

As the sheet stack enters between the folding roller pair 26A, the pressure contact force of the folding roller pair 26A becomes larger. However, the sheet stack is nipped by the folding roller pair 26A, so the sheet stack can be conveyed by the folding roller pair 26A. For this reason, the load on the pushing plate 25*a* can be reduced. In the conventional structure in which one spring is provided, a power consumption of about 165 W is required to fold a sheet stack, but according to this embodiment, it is possible to fold the sheet stack with a power consumption of about 108 W.

In other words, according to this embodiment, the pressure contact force of the folding roller pair 26A at the time when the sheet stack enters between the folding roller pair 26A is small, that is, about 160 N, so a force of pressing to open the nip of the folding roller pair 26A becomes also small. Thus, a force of pushing out the sheet stack in a direction opposite to the pushing direction also becomes small, so even when toner adheres to the sheet stack to thereby lower the friction coefficient μpp between sheets, there is no possibility that only the sheet which is brought into contact with the folding roller pair 26A is conveyed. As a result, the sheet stack can be conveyed without causing any tear in the sheet of the stack.

Figure 11:
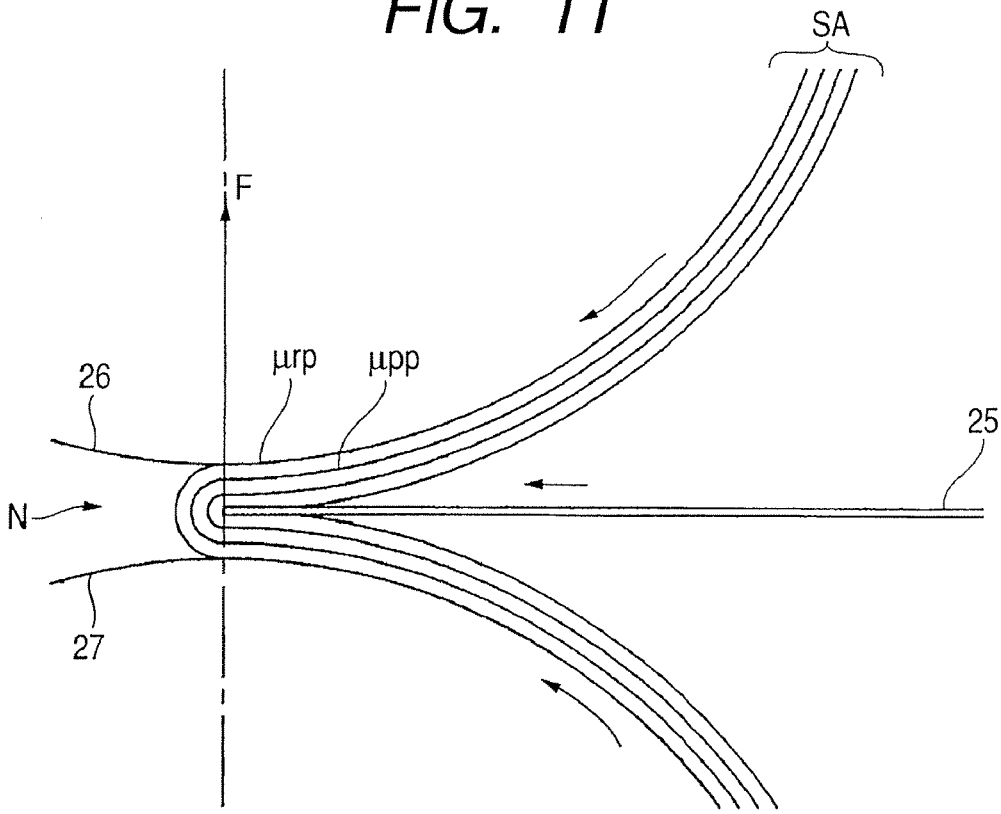
FIG. 11 is an explanatory view showing a state of the folding roller pair of the sheet stack folding apparatus when the sheet stack is being folded.

Further, as the sheet stack enters between the folding roller pair 26A, the pressure contact force of the folding roller pair 26A becomes large, that is, about 800 N. However, in this case, as shown in FIG. 11, a sheet stack SA has already entered in a nip part N between the folding roller pair 26A. Thus, the force of pushing out the sheet stack SA in the direction opposite to the pushing direction is not generated, thereby making it possible to convey the sheet stack SA without causing any tear in the sheet of the stack.

As described above, the upper folding roller 26 is urged by the urging means 700A including the first spring 700 and the second spring 701, in the direction of the lower folding roller 27. Then, the urging means 700A is structured such that the number of the springs 700 and 701 is changed according the thickness of the sheet stack SA to be folded, thereby making it possible to reduce the load on the pushing plate 25*a* at the time when the sheet stack is pushed between the folding rollers, and folding the sheet stack with a small amount of power consumption. As a result, it is possible to perform the bookbinding process on the sheet stack with a small amount of power consumption and without causing any tear in the sheet stack.

In the above description, the explanation is made as to a case where the pressure contact force of the folding roller pair 26A is generated by the two springs 700 and 701, but the pressure contact force of the folding roller pair 26A may be generated by urging members such as three or more springs. Further, the urging member is not limited to the spring, but any types of urging members may be adopted as long as the urging member can generate the pressure contact force.

In the above description, a copying machine is illustrated as an example of the image forming apparatus. However, the present invention is not limited thereto, and may be applied to other types of image forming apparatuses such as a printer and a facsimile machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2005-342966 filed on Nov. 28, 2005, the entire disclosure of which is incorporated herein by reference in its entirety.

What is claimed is:

1. A sheet processing apparatus, which performs a bookbinding process by folding a sheet stack, comprising:

a folding roller pair comprising a first roller and a second roller brought into press contact with the first roller to be contacted/separated with/from the first roller, for conveying the sheet stack while folding the sheet stack;

a plurality of urging members capable of urging the second roller in a direction of the first roller; and an urging mechanism for changing a number of the urging members for urging the second roller, according to a thickness of the sheet stack to be folded;

wherein the urging mechanism comprises a swingable holding member for holding the second roller to be contacted/separated with/from the first roller, and change the number of the urging members for urging the second roller, along with fluctuation of the holding member.

2. A sheet processing apparatus according to claim 1, wherein the urging mechanism is provided with an allowance at a different level so that each one end of the plurality of urging members is sequentially subjected to an engagement according to the thickness of the sheet stack.

3. A sheet processing apparatus according to claim 1, wherein the urging mechanism is provided with an allowance at a different level to engage each one end of the plurality of urging members, along with the fluctuation of the holding member.

4. An image forming apparatus, comprising:

an image forming part for forming an image;

a folding roller pair comprising a first roller and a second roller brought into press contact with the first roller to be contacted/separated with/from the first roller, for conveying a sheet stack on which images are formed while folding the sheet stack;

a plurality of urging members capable of urging the second roller in a direction of the first roller; and an urging mechanism for changing a number of the urging members for urging the second roller, according to a thickness of the sheet stack to be folded;

wherein the urging mechanism comprises a swingable holding member for holding the second roller to be contacted/separated with/from the first roller, and change the number of the urging members for urging the second roller, along with fluctuation of the holding member.

5. An image forming apparatus according to claim 4, wherein the urging mechanism is provided with an allowance at a different level so that each one end of the plurality of urging members is sequentially subjected to an engagement according to the thickness of the sheet stack.

6. An image forming apparatus according to claim 4, wherein the urging mechanism is provided with an allowance at a different level to engage each one end of the plurality of urging members, along with the fluctuation of the holding member.

* * * * *